United States Patent [19]

Hillstrom et al.

[11] Patent Number: 4,958,458

[45] Date of Patent: Sep. 25, 1990

[54] POSTER DISPLAY DEVICE WITH LONGITUDINAL RETENTION OF FRAME SECTIONS BY INSERTS

[75] Inventors: David U. Hillstrom, Novi; Randall Palmer, Farmington Hills; Brian J. Hillstrom, Walled Lake, all of Mich.

[73] Assignee: Marketing Displays, Inc., Farmington Hills, Mich.

[21] Appl. No.: 315,400

[22] Filed: Feb. 23, 1989

Related U.S. Application Data

[63] Continuation-in-part of Ser. No. 25,398, Mar. 13, 1987.

[51] Int. Cl.[5] ..... A47G 1/06; G09F 1/12

[52] U.S. Cl. ..... 40/156; 40/647

[58] Field of Search ..... 40/156, 152, 647

[56] References Cited

U.S. PATENT DOCUMENTS

| | | | |
|---|---|---|---|
| 626,256 | 6/1899 | Webb | 40/613 |
| 1,013,410 | 1/1912 | Lynch | 403/229 |
| 1,267,021 | 5/1918 | Watts | 40/608 |
| 1,437,635 | 12/1922 | Damiana | 16/86 A |
| 1,484,231 | 2/1924 | Pistocco | 40/617 |
| 1,532,865 | 4/1925 | Beck | 404/11 |
| 1,541,200 | 6/1925 | Thomson | 40/606 |
| 1,607,465 | 11/1925 | Kirk et al. . | |
| 1,613,933 | 1/1927 | Castleton | 40/156 |
| 1,726,817 | 9/1929 | Franklin | 40/608 |
| 1,750,118 | 3/1930 | Mueller, Jr. et al. | 40/613 |
| 1,856,349 | 5/1932 | Bigelow | 40/613 |
| 1,882,454 | 10/1932 | Spalding | 160/353 |
| 2,030,379 | 2/1936 | Lippold | 40/617 |
| 2,144,038 | 1/1939 | Trump | 52/113 |
| 2,164,680 | 7/1939 | Donovan | 40/608 |
| 2,165,704 | 7/1939 | Hood | 40/608 |
| 2,292,785 | 8/1942 | Henne | 40/598 |
| 2,603,017 | 7/1952 | Merrill | 40/152 |
| 2,882,633 | 4/1959 | Howell | 40/156 |
| 2,949,324 | 8/1960 | Birge et al. | 403/229 |
| 2,979,842 | 4/1961 | Ridder | 40/156 |
| 3,070,914 | 1/1963 | Henderson et al. | 40/156 |
| 3,205,601 | 9/1965 | Gawne et al. | 40/156 |
| 3,310,901 | 3/1967 | Sarkisian | 40/156 |
| 3,360,893 | 1/1968 | Wattelez | 52/105 |
| 3,386,198 | 6/1968 | Howell | 40/156 |
| 3,662,482 | 5/1972 | Sarkisian | 40/602 |

(List continued on next page.)

FOREIGN PATENT DOCUMENTS

| | | |
|---|---|---|
| 241196 | 10/1962 | Australia . |
| 529802 | 7/1954 | Belgium . |
| 660595 | 3/1965 | Belgium . |
| 835010 | 2/1970 | Canada . |
| 97389 | 11/1968 | Denmark . |
| 0114453 | 8/1984 | European Pat. Off. . |
| 1181967 | 6/1959 | France . |
| 97398 | 10/1960 | Netherlands . |
| 328624 | 4/1958 | Switzerland . |
| 282866 | 12/1927 | United Kingdom . |
| 339325 | 12/1930 | United Kingdom . |
| 479913 | 7/1938 | United Kingdom . |
| 519632 | 4/1940 | United Kingdom . |
| 868268 | 5/1961 | United Kingdom . |
| 893632 | 4/1962 | United Kingdom . |
| 1056999 | 2/1967 | United Kingdom . |
| 1295378 | 11/1972 | United Kingdom . |
| 1404624 | 9/1975 | United Kingdom . |
| 2005535A | 4/1979 | United Kingdom . |
| 2142259A | 1/1985 | United Kingdom . |

OTHER PUBLICATIONS

NEWS–The Society of the Plastics Industry, Inc., New York–7/21/83 (3 pages).

*Primary Examiner*—Cary E. Stone

*Attorney, Agent, or Firm*—Brooks & Kushman

[57] ABSTRACT

An improved poster frame and display holder for replaceable posters and similar advertising material is disclosed. The sides of the frame include sets of interconnected, and preferably pivotably engaged, extruded metal, molded plastic, or other front and back frame members. A spring member biases the front and back members together for releasably holding a poster or similar display. Interlocking portions of, or attachments to, the front or back members substantially prevent relative longitudinal movement therebetween, while still allowing relative pivotal movement therebetween.

33 Claims, 5 Drawing Sheets

U.S. PATENT DOCUMENTS

| | | | |
|---|---|---|---|
| 3,720,979 | 3/1973 | Krawagna | 16/150 |
| 3,745,680 | 7/1973 | Faust | 40/156 |
| 3,885,335 | 5/1975 | Egermayer | 40/156 |
| 4,039,770 | 8/1977 | Bott | 40/209 |
| 4,094,083 | 6/1978 | Fund | 40/536 |
| 4,138,787 | 2/1979 | Sarkisian et al. | 40/156 |
| 4,145,828 | 3/1979 | Hillstrom | 40/156 |
| 4,235,030 | 11/1980 | Astolfi | 40/156 |
| 4,237,632 | 12/1980 | Segerstad | 40/156 |
| 4,358,917 | 11/1982 | Oda et al. | 52/717 |
| 4,364,192 | 12/1982 | Lloyd | 40/155 |
| 4,512,094 | 4/1985 | Seely | 40/156 |
| 4,512,095 | 4/1985 | Seely | 40/156 |
| 4,519,152 | 5/1985 | Seely et al. | 40/156 |
| 4,523,400 | 6/1985 | Seely | 40/156 |
| 4,580,361 | 4/1986 | Hillstrom et al. | 40/603 |
| 4,702,025 | 10/1987 | Mace | 40/647 |
| 4,756,107 | 7/1988 | Hillstrom et al. | 40/603 |
| 4,782,610 | 11/1988 | Hillstrom et al. | 40/156 |

POSTER DISPLAY DEVICE WITH LONGITUDINAL RETENTION OF FRAME SECTIONS BY INSERTS

BACKGROUND AND SUMMARY OF THE INVENTION

This is a continuation-in-part of the copending U.S. patent application, Ser. No. 025,398, filed Mar. 13, 1987, pending, the disclosure of which is hereby incorporated by reference.

The present invention relates to an improved poster frame and display holder for various types of replaceable posters and similar advertising materials. The frame and holder can be utilized in various indoor and outdoor areas, such as on buses, street cars, taxicabs, and similar mobile installations, as well as on fixed mounts such as service stations, on building walls, on posts and the like.

The present invention is an improvement over the invention disclosed and claimed in U.S. Pat. Nos. 4,145,828 and 3,310,901, and is also related to U.S. Pat. Nos. 4,756,107; 4,580,361; 4,523,400; 4,519,152; 4,512,095; 4,512,094; and 4,138,787, all of which are owned by the assignee of the present invention, and the disclosures of which are all incorporated by reference herein.

In accordance with the present invention, a display holder includes a plurality of generally elongated frame sections, which can be fabricated from extruded metal members, molded plastic members, or other suitable materials. Each frame section includes a front and back member adapted to be assembled in an aligned interconnected arrangement, and preferably pivotally interconnected for relative pivotal movement throughout a range of relatively pivoted positions. One of the front and back members has a laterally-protruding discontinuity formed therein, or interconnected therewith. The laterally-protruding discontinuity interlockingly engages the other of the front or back members in order to substantially prevent sliding or other longitudinal movement of the front and back members relative to one another when assembled. In the preferred pivotally interconnected arrangement, such longitudinally interlocking relationship is maintained throughout the range of relative pivotal movement. In at least some of the preferred embodiments, the longitudinal relationship is formed without creating an opening through the outer portions of the material of the front or back member through which water, dust, or other foreign elements can enter the assembly.

Preferably, the longitudinally interlocking relationship is formed after the front and back members are assembled and aligned in order to substantially assure alignment of the display holder in its installed condition. In at least one embodiment, the laterally-protruding discontinuity can advantageously include surface discontinuities thereon in order to assure a non-slip interlocking engagement or interconnection between the front and back members, while still maintaining the capability of relative movement of the members.

Other objects, features and advantages of the invention will become apparent from the following description of the invention when viewed in conjunction with the accompanying drawings and claims.

DETAILED DESCRIPTION OF THE PREFERRED EMBODIMENTS

Figures 1, 2:
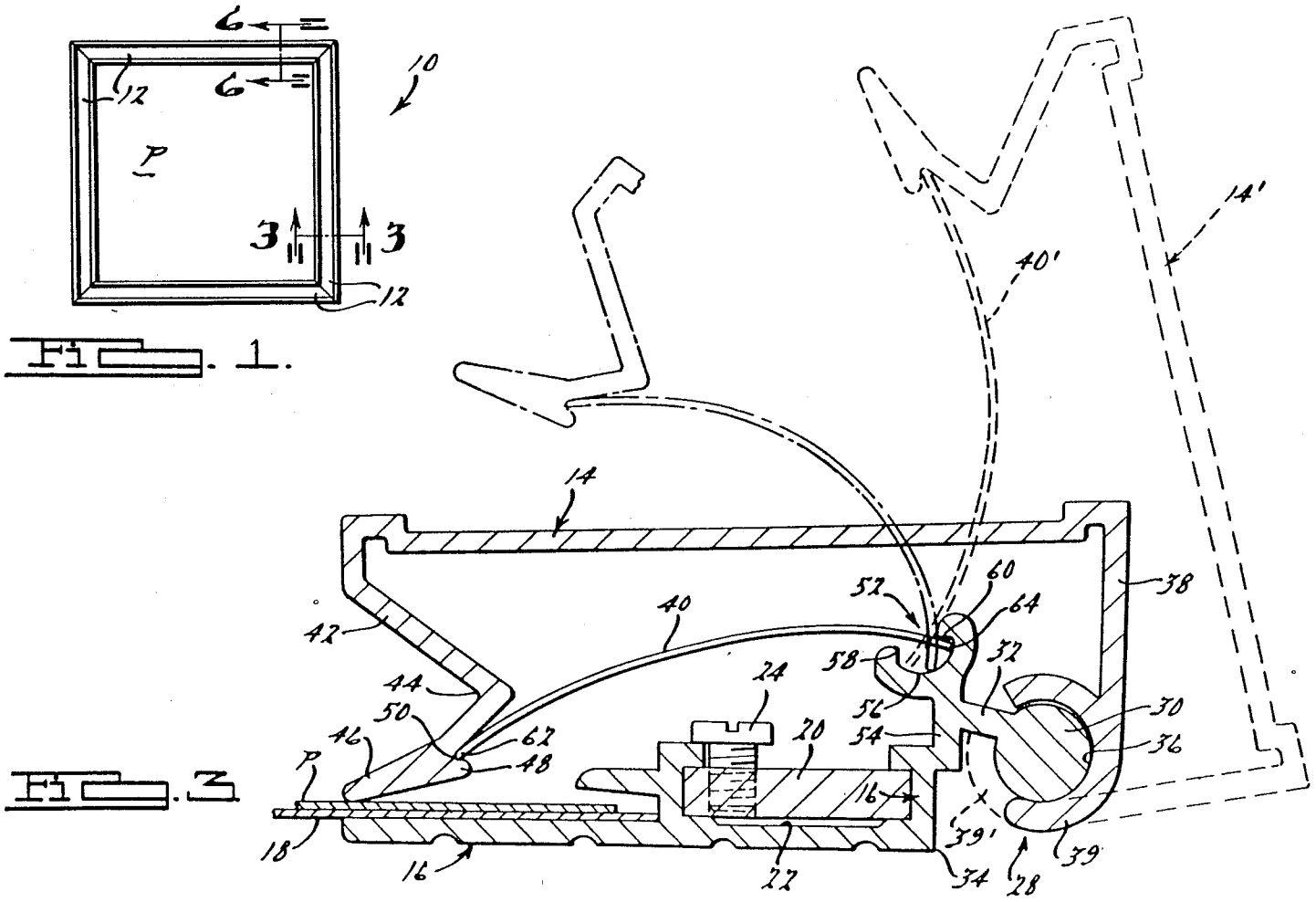
FIG. 1 is a front view of an improved display holder in accordance with the present invention.
FIG. 2 is a fragmentary perspective view of a corner section of the display holder shown in FIG. 1, constructed in accordance with one embodiment of the invention.
Figure 3:
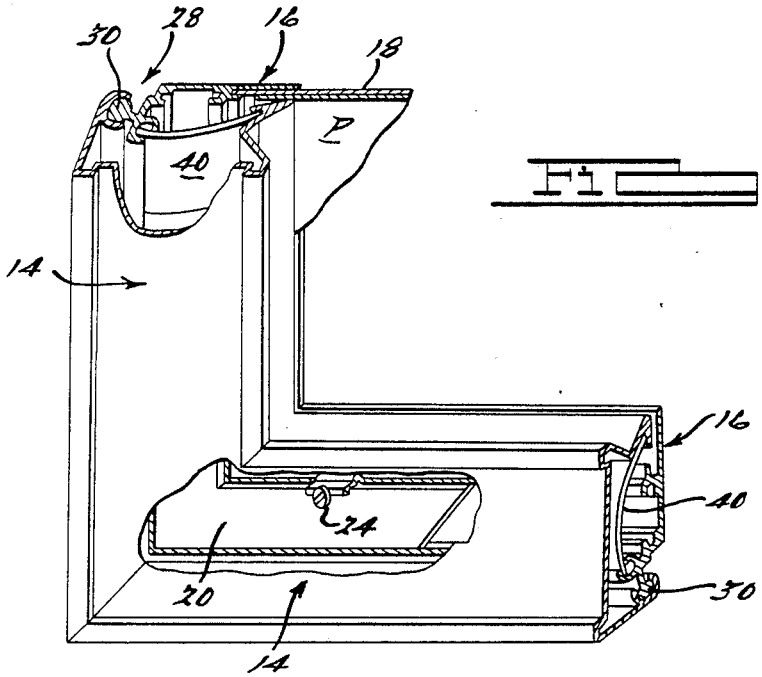
FIG. 3 is a cross-sectional view taken along line 3—3 of FIG. 1.

As illustrated in FIG. 1, an exemplary display holder and poster frame, generally designated by the reference numeral 10, is made up of a plurality of frame sections 12. As shown in FIGS. 2 and 3, each of the frame sections 12 are made essentially of two elongated members 14 and 16 which are preferably pivoted together. The respective front and back members 14 and 16 of each section 12 are cut to the desired length and mitered at 45 degree angles at their opposite ends for abutting and coplanar assembly with one another to outline the frame 10. As will be understood, the frame 10 is typically square or rectangular, although it is also possible for the frame 10 to have any desired polygonal or other shape with an appropriate number of sections 12 mitered at appropriate angles. Also, it is possible for each of the front or cover members 14 to be comprised of a number of extruded pieces of shorter length positioned end-to-end, for example.

The display holder and frame 10 preferably includes a rigid backing member 18 which can be made of wood, pressboard, aluminum, plastic, or another suitable material, with the frame sections 12 positioned around the edges of the backing member 18 to form the completed display holder. A poster P or other display member is positioned on the backing member 18 and held in place around its edges by the frame sections 12. The back member 16 can be fastened in any conventional means to a rigid supporting member, such as a post, wall or the like. Although its presence is preferred in most applications, the backing member 18 is not necessary in all situations, since the display holder and frame 10 can also be mounted on a flat surface that forms its own backing member, or the poster P could be made of a rigid or stiff material that does not require a backing member for support.

The front and back members 14 and 16 are preferably made of a material which can be efficiently and economically extruded, molded, or otherwise suitably fabricated, which presents an attractive external appearance, and which maintains a pleasing and durable structure for an indefinite length of time. Suitable materials include plastic, aluminum, and magnesium, for example.

Adjacent sections 12 of the frame 10 can be held and fastened together by corner braces 20, or by other suitable means known to those skilled in the art. The braces 20, which can be of an angular configuration, or a curved configuration if radiused corners are employed, are positioned in suitable recesses 22 in each of the back members 16 and held in place by screws 24, snap-together post arrangements, or otherwise suitably secured.

As shown generally in FIGS. 2 and 3, the outer or front member 14 of each frame section 12 is assembled to the back member 16 by means of a hinge assembly 28. The hinge assembly 28 is comprised of a cylindrical hinge or pivot pintle formation 30 that is held in an outwardly offset relationship by a bridge element 32 from the back wall 34 of the back member 16 and a corresponding cup-shaped socket portion 36 formed on the back panel 38 of the front member 14. The edges of the cup or socket 36 preferably extend more than 180 degrees about the pivot pintle 30 and the two members 14 and 16 thus are either slidably assembled in the longitudinal direction or snapped together.

As shown by the dashed phantom lines in FIG. 3, the hinge assembly 28 allows the front or cover member 14 to pivot relative to the back member 16. When the front or cover member 14 is in the position shown in solid lines in FIG. 3, it holds the poster P in position in the frame against the backing member 18. When the poster P is to be removed or replaced, the front member 14 is rotated to the pivoted position 14', thus permitting removal of the poster P. The rotation of the front member 14 is preferably limited by stop end 39 of back panel 38, and thus when the front member 14 is swung to its fully open position 14', the stop end 39 rests against the bridge element 32 (as shown by numeral 39' in FIG. 3), One or more leaf springs 40 are positioned and resiliently deflected in each section 12 between the front and back members 14 and 16. The springs 40 act to maintain a snug mating pivotal engagement of members 14 and 16 and to bias the front members 14 against the poster P and the backing member 18 when the frame sections 12 are "closed", as well as holding the front members 14 in their "open" upright position (14' in FIG. 3) for removal or replacement of poster P. The springs 40 are preferably composed of a spring steel or a plastic and have a generally flat, rectangular shape in their free state.

The front member 14 has a side panel 42 with a longitudinal groove 44 formed therein so that the front member 14 may be grasped, and opened or closed relative to the back member 16. The end 46 of side panel 42 is adapted to engage and clamp the poster P in place in the display holder. An outwardly and upwardly hook portion 48 is provided adjacent the end 46 to form a longitudinal groove or recess 50 within which one end 62 of the spring 40 is positioned when the front and back members 14 and 16 are assembled together and the spring 40 is installed in place. The groove 50 has sufficient depth to retain the end 62 of spring 40 when the front member 14 is opened and closed.

The opposite end 64 of the spring 40 is positioned in an arcuately-shaped channel 52 formed in the upstanding flange portion 54 of the back 16. The channel 52 extends longitudinally in the back member 16, and has an arcuate portion 56 extending through an arc of approximately 90 degrees. The arcuate portion 56 is bounded on its two sides by flat walls 58 and 60, the planes of which are substantially perpendicular to each other. The shape and position of the channel 52 allows unrestricted movement of end 64 of spring 40 over a 90 degree arc as the front member 14 is opened and closed and also prevents the end 64 from being displaced therefrom. The channel 52 further allows use of a flat spring 40, which can be easily manufactured without expensive and time-consuming roll forming and bending, which does not require stringent manufacturing tolerances, and which can be quickly and easily installed in the frame sections 12.

In the assembly of the frame sections 12, the front and back members 14 and 16 are first longitudinally slid or snapped together at the hinge assembly 28. The front member 14 is then fully swung to its open position (14' in FIG. 3), as limited by the stop end 39, and the end 64 of spring 40 is positioned in the arcuate channel 52. A force is then applied to the spring 40 until its end 63 thereof is urged past the end of hook formation 48 and snapped into its final position in groove 50.

Figure 4:
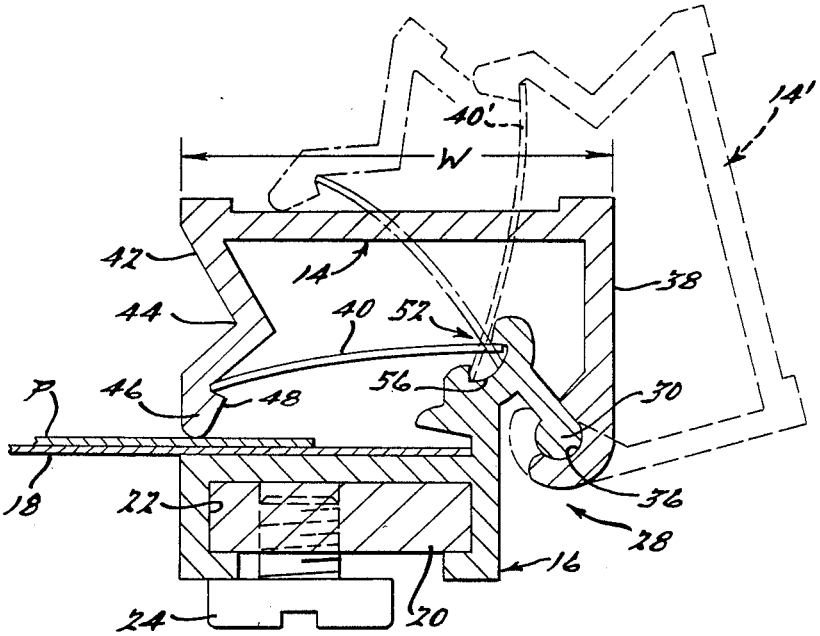
FIG. 4 is a partial cross-sectional view similar to that of FIG. 3, but illustrating another embodiment of the present invention.

Another embodiment of the invention is shown in FIG. 4 and is designed for small frame applications. Most of the parts of the frame shown in FIG. 4 are similar to those above-described with reference to FIGS. 1 through 3, and are thus indicated by similar reference numerals. The primary differences between the embodiments of FIGS. 1 through 3 and FIG. 4 are the widths W of the front and back members 14 and 16 and the positioning of the brace 20 in the recess 22. The unique arrangement of the spring 40 and mating recesses described above allow the frame sections to be very small, with a width W on the order of three-quarters of an inch, while still allowing the frame sections to operate in the same manner as much larger frame sections.

The foregoing discussion provides a general description of the display holder assembly disclosed and claimed in the above-mentioned U.S. Pat. No. 4,145,828 for purposes of illustration. As will be readily appreciated by one skilled in the art, the improvement provided by the present invention is equally applicable to frames or display holders other than that shown for purposes of illustration on the drawings, including many of the frame and display holder assemblies disclosed in the various U.S. patents listed above and incorporated by reference herein, or variations thereon.

Figure 5:
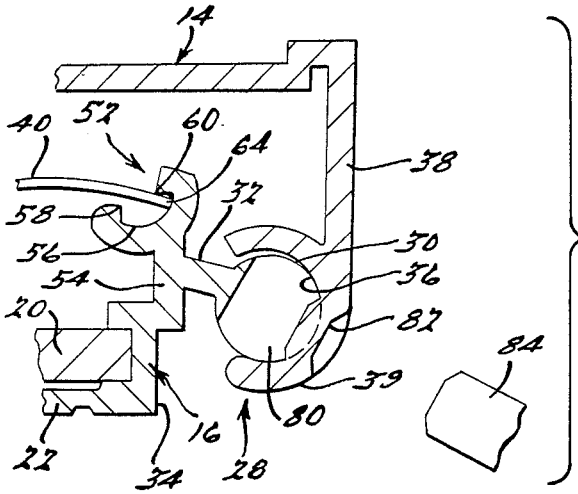
FIG. 5 is a detailed partial cross-sectional view, similar to that of FIG. 3, but illustrating a longitudinal retention arrangement for the front and back members of the display holder frame sections in accordance with one embodiment of the present invention.
Figure 6:
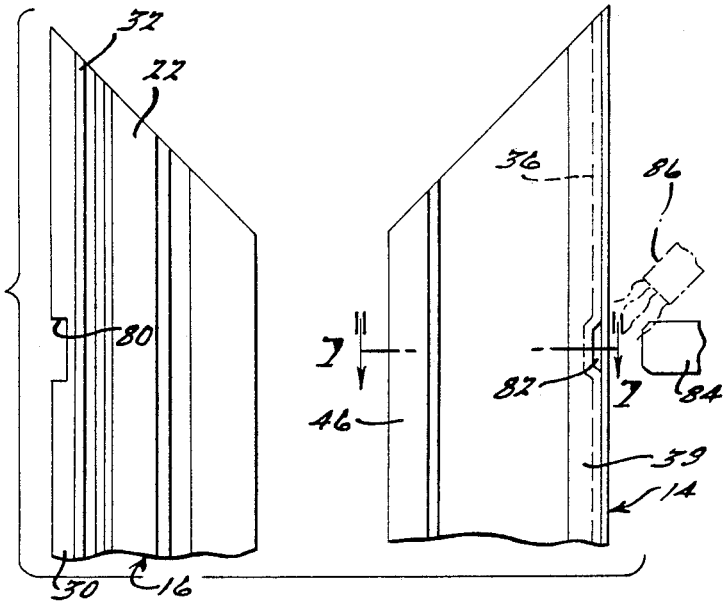
FIG. 6 is a partial detail view of the front and back frame members, shown separated from one another and further illustrating the retention arrangement of FIG. 5.
Figure 7:
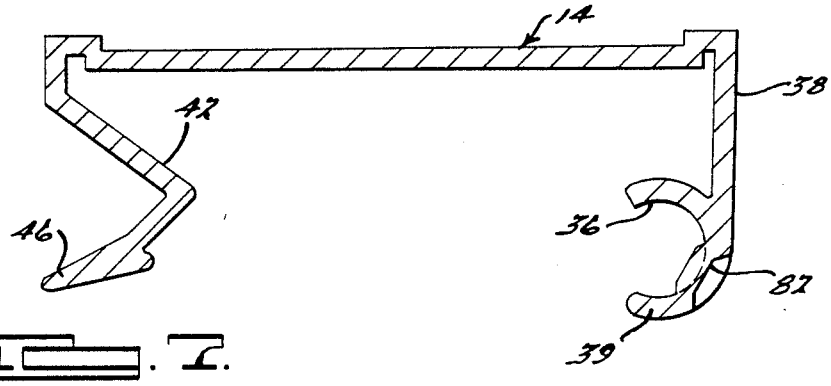
FIG. 7 is a cross-sectional view taken generally along line 7—7 of FIG. 6.

In FIGS. 5 through 7, a retention arrangement for preventing relative longitudinal sliding or other movement of the front and back members 14 and 16 is illustrated. The socket portion 36 of the front member 14 has a laterally-protruding dimple or discontinuity 82 formed therein at a longitudinal position corresponding to the longitudinal postion of a laterally recessed slot or other recessed portion 80 formed in the pintle portion 30 of the back member 16. When the front and back members 14 and 16 are assembled, as shown in FIGS. 1 through 4, the discontinuity 82 is longitudinally interlockingly received within the laterally recessed portion 80 in order to prevent the front and back members 14 and 16 from being longitudinally moved out of alignment relative to one another.

Preferably, the discontinuity 82 is formed in the front member 14 without shearing or otherwise creating an opening through the material of the socket portion 36 in order to substantially avoid the entry of water, dust, debris, or other foreign materials into the frame section assembly. Likewise, the laterally recessed slot 80 is preferably formed in the back member 16 so as to avoid creating an opening that extends all the way through the material of the back member 16. Rather, the laterally recessed slot 80 is preferably cut, molded, or otherwise formed partially through the pintle portion 30. In this regard, it should be noted that a similar laterally recessed portion can alternately be formed in the socket portion 36 of the front member 14, and a similar laterally-outwardly protruding discontinuity can alternately be formed on the pintle portion 30 of the back member 16, in lieu of the opposite arrangement depicted in FIGS. 5 through 7.

In this embodiment, the shape and configuration of the discontinuity 82 and the laterally recessed slot 80 are such that their longitudinally interlocking relationship is maintained throughout the full range of pivotal movement of the front and back members 14 and 16 relative to one another. By such an arrangement, the above-mentioned longitudinally interlocking retention of the front and back members 14 and 16 is retained during all modes of operation or function of the display holder 10.

Preferably, the retention arrangement for the display holder 10 in this embodiment is fabricated by first forming the laterally recessed slot 80 at its predetermined longitudinal position on the back member 16, assembling the front and back members 14 and 16 as shown in FIGS. 1 through 4, and then forming the laterally-protruding discontinuity 80 at the corresponding longitudinal position on the front member 14. By following such a fabrication and assembly procedure, it is substantially assured that the discontinuity 82 will be properly aligned with the laterally recessed slot 80 when the front and back members 14 and 16 are assembled.

The formation of the discontinuity 82 can be accomplished in any of a number of ways known to those skilled in the art, such as by laterally deforming a portion of the socket 36 of the front member 14 by way of a staking operation using a staking tool (diagrammatically illustrated by reference numeral 84 in FIG. 6). Alternately, if the front and back members 14 and 16 are composed of a molded plastic material, the laterally recessed slot 80 can be molded into the back member 16, the members 14 and 16 can be assembled, and the discontinuity 82 can be formed thereafter by heating a portion of the front member 14, using a heat source illustrated diagrammatically in FIG. 6 by reference numeral 86, and then laterally deforming the heated portion inwardly by way of the staking tool 84 or other such suitable deformation tools known to those skilled in the art. In still another alternate construction, wherein the front and the back members 14 and 16 are composed of a moldable plastic material, both the laterally recessed slot 80 and the laterally-protruding discontinuity 82 can be formed during the molding of their respective members 16 and 14, and then snapped into their above-discussed longitudinally interlocking relationship during the interconnection of the front and back members 14 and 16.

Many of the fabrication or forming techniques described above can also be employed in the above-mentioned alternate or opposite arrangement, wherein the laterally-protruding discontinuity 82 is formed in the back member 16, and a corresponding laterally recessed slot 80 is formed in the front member 14.

Figure 8:
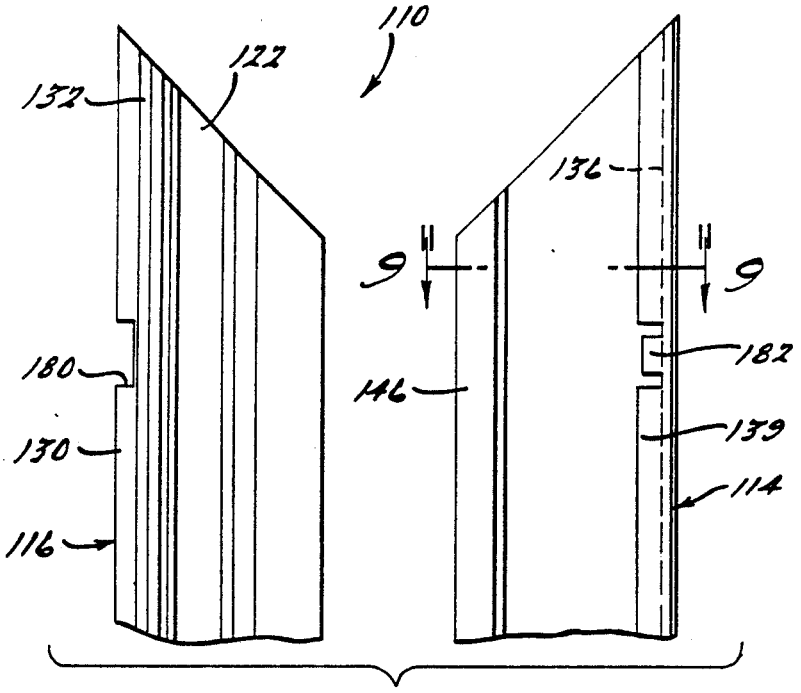
FIG. 8 is a partial detail view similar to that of FIG. 6, but illustrating another alternate longitudinal retention arrangement for the front and back members.
Figure 9:
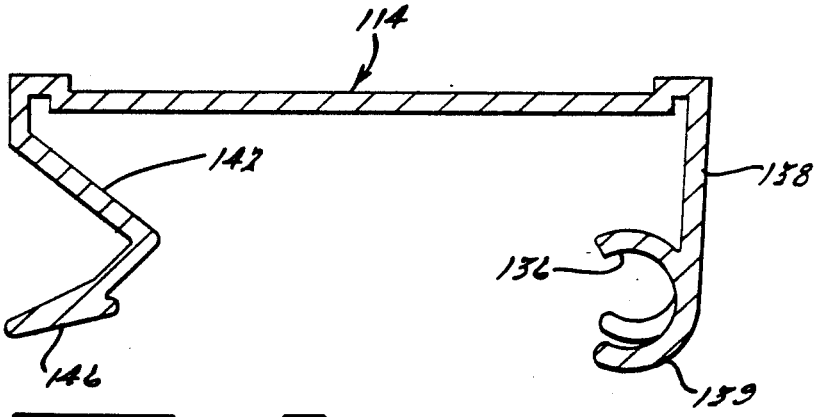
FIG. 9 is a cross-sectional view taken generally along line 9—9 of FIG. 8.

FIGS. 8 and 9 illustrate still another alternate arrangement according to the present invention, wherein a display holder 110 is generally similar to the display holder 10 described above in connection with FIGS. 1 through 7, with similar or corresponding elements and components thereof indicated by reference numerals similar to those of FIGS. 1 through 7, but having a one-hundred prefix. In FIGS. 8 and 9, a laterally-protruding tab or other discontinuity 182 is cut and formed into the socket portion 130 of the front member 114, in place of the staked or dimpled discontinuity 82 shown in FIGS. 5 through 7. In other respects, the alternate arrangement shown in FIGS. 8 and 9 is substantially similar, both in configuration and function, to that shown in FIGS. 5 through 7. Similarly, one skilled in the art will readily recognize that the relative positions of the discontinuity 182 on the front member 114, and the laterally recessed slot 180 on the back member 116, can optionally or alternately be reversed such that the discontinuity 182 is formed in the back member 116, and the laterally recessed slot 180 is formed in the front member 114.

Figure 10:
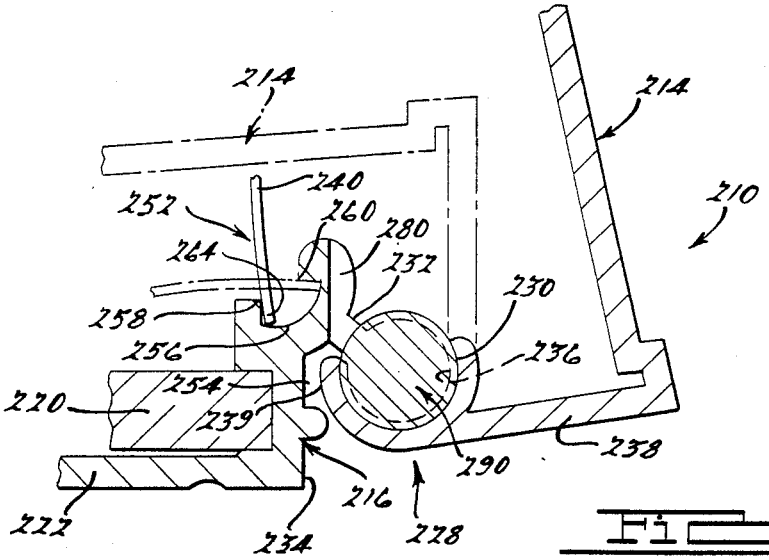
FIG. 10 is a view similar to that of FIG. 5, but illustrating a preferred embodiment of the retention arrangement according to the present invention.
Figure 11:
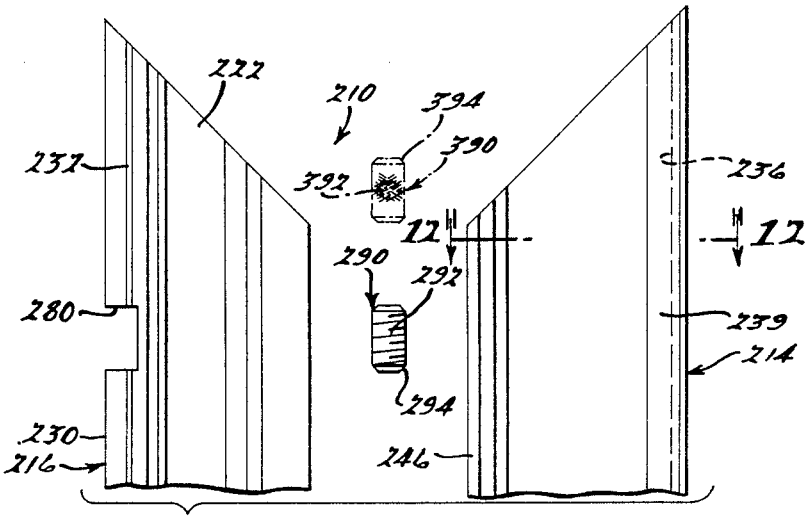
FIG. 11 is a view similar to that of FIGS. 6 and 8, but illustrating the retention arrangement of FIG. 10.
Figure 12:
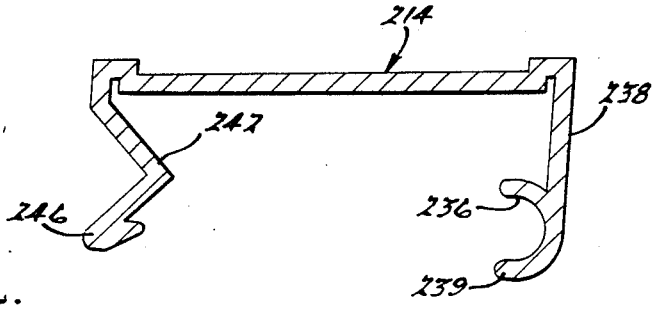
FIG. 12 is a cross-sectional view taken generally along line 12—12 of FIG. 11.

FIGS. 10 through 12 illustrate a further alternate embodiment according to the present invention, which is believed to be the preferred arrangement, wherein a display holder 210 is generally similar in many respects to the display holders 10 and 110 described above in connection with FIGS. 1 through 9. Similar or corresponding elements and components of the display holder 210 are indicated by reference numerals similar to those of FIGS. 1 through 9, but having a two-hundred prefix.

In FIGS. 10 through 12, a laterally-protruding rod member 290 is interconnected with the pivot pintle 230, preferably by being inserted into an opening or groove 280 formed in the back member 216, and interlockingly engages the socket 236 in the front member 214. The opening or groove 280 is sized such that it snugly engages the longitudinal ends of the elongated rod member 290, and thus the engagement of the elongated rod member 290 with the socket portion 236 forms an interlocking relationship between the front and back members 214 and 216 when they are assembled in an aligned, interconnected condition.

Preferably, the rod member 290 is force-fitted into the socket portion 236, after the front and back members 214 and 216 are assembled together and mutually aligned in a desired relationship, to form a substantially "permanent" interlocking relationship that still allows relative pivotal movement between the front and back members 214 and 216. Preferably, in order to substantially assure that the desired alignment between the front and back members 214 and 216 is maintained, the rod member 290 includes a number of surface discontinuities 292 thereon. Such surface discontinuities 292 can include one or more generally helical or spirally-extending thread-like protuberances, but may also alternately be formed by knurling the lateral surface of the rod member, such as is illustrated in phantom lines in FIG. 11 and indicated by the knurled portion 392 on the alternate rod member 390. Other patterns or formations of the protuberances forming the surface discontinuities on the rod member 290 or 390 can also alternately be employed, such as one or more rings, ribs, or other such protuberances that will readily occur to one skilled in the art. In this regard, as will also be readily recognized by one skilled in the art, the surface discontinuities, such as those indicated for purposes of illustration by reference numerals 292 and 392 in FIG. 11, can be alternately eliminated, leaving the rod member with a substantially smooth outer lateral surface. In such a construction, however, a substantially tight force-fitted relationship between the rod member and the interior of the socket portion 236 is important in order to substantially prevent relative longitudinal movement between the front member 214 and the back member 216.

In addition to the preferred, but optional, inclusion of the surface discontinuities 292 or 392 on the rod members 290 or 390, either or both of such rod members can optionally have one or both of their longitudinal ends chamfered or tapered, as is illustrated by reference numerals 294 and 394, respectively, in FIG. 11. Such chamfering or tapering facilitates the ease of insertion of the rod member 290 or 390 into the opening 280 formed in the back member 216. This feature is desirable in many applications due to the relatively tight, snug engagement of the longitudinal ends of the rod member with the side portions of the opening 280, which is important for maintaining the front and back members 214 and 216 in their proper, aligned relationship.

The arrangement or embodiment depicted in FIGS. 10 through 12 is advantageous for many reasons, including the fact that no special forming, deforming, or other special fabrication in the socket portion 236 of the front member 214 is required in order to attain the desired interlocking relationship for purposes of preventing relative longitudinal movement or misalignment of the front and back members 214 and 216, respectively, as is illustrated by the lateral cross-sectional representation of the front member 214 depicted in FIG. 12. Another advantage of the arrangement depicted in FIGS. 10 through 12 is that because no special pre-forming or deforming of the socket portion 236 of the front member 214 is required, the rod member 290 or 390 is inserted after the display holder 210 is installed and the front and back members 214 and 216 have been interconnected and adjusted to a desired, neat appearing aligned relationship. Such aligned relationship is then maintained, while still allowing relative pivotal movement, after assembly of the other components merely by inserting the rod member 290 or 390 through the opening 280 and into the above-discussed interlocking relationship with the socket portion 236 of the front member 214. In this regard, it should be noted that in other applications of the present invention, wherein a certain predetermined longitudinal positioning of the two interconnected members is desired, the rod member can be inserted into such an interlocking relationship prior to installation of the device incorporating the present invention, thus substantially assuring that the predetermined relative longitudinal positioning is preserved and maintained during installation and use. In most instances, however, the previously-discussed field or installation pre-adjustment, prior to insertion of the rod member, is preferred.

Finally, as one skilled in the art will readily recognize, the above-discussed relationship, wherein the rod member is inserted through an opening in the back member 216 for engagement with the front member 214 can optionally be reversed in a display holder having the pintle portion 230 on the front member 214 and the socket portion 236 on the back member 216, in lieu of the exemplary relationship depicted in the drawings for purposes of illustration.

The foregoing discussion discloses and describes exemplary embodiments of the present invention. One skilled in the art will readily recognize from such discussion, and from the accompanying drawings and claims, that various changes, modifications, and variations may be made therein without departing from the spirit and scope of the invention as defined in the following claims.

What is claimed is:

1. In a display holder having a plurality of elongated frame sections forming a frame structure for receiving and holding a display piece, each of said sections having a pair of elongated front and back members adapted to be assembled in a longitudinally aligned interconnected arrangement with one another, the improvement wherein a first of said elongated front and back members has an opening formed therein and an elongated rod member insertably received in said opening, said rod member interlockingly engaging the other of said elongated front and back members in order to substantially prevent longitudinal movement of said front and back members relative to one another when in said aligned interconnected arrangement.

2. The invention according to claim 1, wherein said elongated front and back members are adapted to be assembled in a pivotal relationship relative to one another for relative pivotal movement throughout a range of relatively pivoted positions, said rod member interlockingly engaging said other of said elongated front and back members in order to substantially prevent said relative longitudinal movement throughout said range of relatively pivoted positions.

3. The invention according to claim 1, wherein said rod member includes a number of surface discontinuities thereon, said surface discontinuities engaging said other of said elongated front and back members when in said aligned interconnected arrangement.

4. The invention according to claim 3, wherein said rod member includes at least one chamfered end portion in order to facilitate the insertion of said rod member into said opening in said first of said elongated front and back members for engagement with said other of said elongated front and back members.

5. The invention according to claim 3, wherein said surface discontinuities include helical threads formed on said rod member.

6. The invention according to claim 3, wherein said surface discontinuities include knurling formed on said rod member.

7. The invention according to claim 3, wherein said elongated front and back members are adapted to be assembled in a pivotal relationship relative to one another for relative pivotal movement throughout a range of relatively pivoted positions, said rod member interlockingly engaging said other of said elongated front and back members in order to substantially prevent said relative longitudinal movement throughout said range of relatively pivoted positions.

8. The invention according to claim 1, wherein said other of said front and back members includes a laterally recessed portion formed therein at a longitudinal position corresponding to said predetermined longitudinal position of said rod member on said first of said elongated front and back members when in said aligned interconnected arrangement, said rod member being longitudinally interlockingly received within said laterally recessed portion of said other elongated front and back members when in said aligned interconnected arrangement.

9. The invention according to claim 8, wherein said display holder is fabricated by first forming said laterally recessed portion at said predetermined longitudinal position in said other of said elongated front and back members, assembling said front and back members in said aligned interconnected arrangement, and inserting said rod member at said predetermined longitudinal position on said first of said elongated front and back members after said assembly in order to substantially assure that said rod member is longitudinally interlockingly received in said laterally recessed portion when said front and back members are assembled in said aligned interconnected arrangement.

10. The invention according to claim 9, wherein at least said laterally recessed portion is pre-formed in said other of said elongated front and back members during the fabrication thereof.

11. The invention according to claim 8, wherein said elongated front and back members are each fabricated by molding a moldable plastic material, said laterally recessed portion being preformed in said other of said front and back members during the molding thereof, said rod member being inserted into said interlocking relationship with said laterally recessed portion during said assembly of said elongated front and back members.

12. The invention according to claim 8, wherein said laterally recessed portion is formed in said elongated back member, said rod member is inserted in said elongated front member.

13. The invention according to claim 8, wherein said laterally recessed portion is formed in said elongated front member, said rod member is inserted in said elongated back member.

14. The invention according to claim 1, wherein said rod member is inserted in said elongated back member.

15. The invention according to claim 1, wherein said rod member is inserted in said elongated front member.

16. A display holder having a plurality of frame sections forming a frame structure for receiving and holding a display piece, each of said sections having an elongated front member and an elongated back member adapted to be assembled in a pivotal relationship with one another, said front member and said back member being provided with coacting hinge formations integral therewith and in mating pivotal engagement with one another, the improvement comprising in combination first channel means formed in said back member, second channel means formed in said front member, and a spring means positioned in and extending between said first and second channel means with said first channel means substantially enclosing one end of said spring means and having an arcuate-shaped center portion flanked on both sides by substantially flat wall portions, a first of said front and back members having an opening formed therein and an elongated rod member insertably received in said opening, said rod member interlockingly engaging the other of said elongated front and back members in order to substantially prevent longitudinal movement of said front and back members relative to one another when assembled.

17. The invention according to claim 16, wherein said front and back members are adapted to be assembled in a pivotal relationship relative to one another for relative pivotal movement throughout a range of relatively pivoted positions, said rod member interlockingly engaging said other of said elongated front and back members in order to substantially prevent said relative longitudinal movement throughout said range of relatively pivoted positions.

18. The invention according to claim 16, wherein said rod member includes a number of surface discontinuities thereon, said surface discontinuities engaging said other of said elongated front and back members when in said aligned interconnected arrangement.

19. The invention according to claim 18, wherein said rod member includes at least one chamfered end portion in order to facilitate the insertion of said rod member into said opening in said first of said elongated front and back members for engagement with said other of said elongated front and back members.

20. The invention according to claim 18, wherein said surface discontinuities include helical threads formed on said rod member.

21. The invention according to claim 18, wherein said surface discontinuities include knurling formed on said rod member.

22. The invention according to claim 18, wherein said elongated front and back members are adapted to be assembled in a pivotal relationship relative to one another for relative pivotal movement throughout a range of relatively pivoted positions, said rod member interlockingly engaging said other of said elongated front and back members in order to substantially prevent said relative longitudinal movement throughout said range of relatively pivoted positions.

23. The invention according to claim 16, wherein said other of said front and back members includes a laterally recessed portion formed therein at a longitudinal position corresponding to said predetermined longitudinal position of said rod member on said first of said elongated front and back members when in said aligned interconnected arrangement, said rod member being longitudinally interlockingly received within said laterally recessed portion of said other elongated front and back members when in said aligned interconnected arrangement.

24. The invention according to claim 23, wherein said display holder is fabricated by first forming said laterally recessed portion at said predetermined longitudinal position in said other of said front and back members, assembling said front and back members, and inserting said rod member at said predetermined longitudinal position on said first of said front and back members after said assembly in order to substantially assure that said rod member is longitudinally interlockingly received in said laterally recessed portion when said front and back members are assembled.

25. A poster display frame having a plurality of frame sections for receiving, holding and displaying a display indicia, each of said frame sections comprising a front member and back member hinged together in a pivotal relationship to one another and a spring for biasing the front and back members together and holding them in closed and open positions for respectively clamping in place and removing said display indicia, said back member having an opening therein, and insert means positioned in said opening and interlockingly engaging said elongated front member in order to substantially prevent longitudinal movement of said front and back members relative to one another when assembled.

26. The invention according to claim 25, wherein said front and back members are adapted to be assembled in a pivotal relationship relative to one another for relative pivotal movement throughout a range of relatively pivoted positions, said rod member interlockingly engaging said elongated front member in order to substantially prevent said relative longitudinal movement throughout said range of relatively pivoted positions.

27. A display frame for receiving, holding and displaying display indicia, said frame comprising (a) at least one frame section, (b) said frame section having a front member and a back member, (c) hinge means for rotatably interconnecting together said back member and said front member, (d) biasing means for biasing said front member and said back member together, (e) said hinge means having a first hinge member on said back member and a second hinge member on said front member, (f) said first hinge member having a discontinuity therein, and (g) insert means positioned in said discontinuity in said first hinge member and interlockingly engaging said second hinge member in order to substantially prevent longitudinal movement of said front member and said back member relative to one another.

28. The display frame as set forth in claim 27 wherein a plurality of frame sections are provided.

29. The display frame as set forth in claim 27 wherein said insert means comprises a rod member.

30. The display frame as set forth in claim 27 wherein said first hinge member comprises a pintle means having a certain cross-sectional diameter and said insert means is slightly larger in diameter than the cross-sectional diameter of said pintle means.

31. The display frame as set forth in claim 27 wherein said second hinge member comprises a socket means and said insert means has surface discontinuities thereon, said surface discontinuities engaging said socket means.

32. The display frame as set forth in claim 27 wherein said biasing means comprises a spring member extending between said front member and said back member.

33. The display frame as set forth in claim 27 wherein said first hinge member comprises an elongated pintle means and said second hinge member comprises an elongated socket means.

* * * * *